US007234978B2

(12) United States Patent
Pade

(10) Patent No.: US 7,234,978 B2
(45) Date of Patent: Jun. 26, 2007

(54) SECONDARY LOCKING OF A PLUG-IN CONNECTION ON TWO PLANES

(75) Inventor: Wolfgang Pade, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/517,158

(22) PCT Filed: Feb. 13, 2003

(86) PCT No.: PCT/DE03/00423

§ 371 (c)(1),
(2), (4) Date: Dec. 13, 2005

(87) PCT Pub. No.: WO03/103100

PCT Pub. Date: Dec. 11, 2003

(65) Prior Publication Data

US 2006/0105638 A1 May 18, 2006

(30) Foreign Application Priority Data

Jun. 4, 2002 (DE) ..... 202 08 632 U

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS

| | | | | |
|---|---|---|---|---|
| 5,713,760 | A * | 2/1998 | Chemin | 439/595 |
| 6,155,888 | A * | 12/2000 | Kurimoto | 439/752 |
| 6,338,654 | B1 | 1/2002 | Sasaki et al. | |
| 6,648,699 | B1 * | 11/2003 | Makino et al. | 439/752 |
| 6,682,367 | B2 * | 1/2004 | Suzuki | 439/595 |
| 6,685,506 | B1 * | 2/2004 | Nakamura et al. | 439/595 |
| 6,716,069 | B2 * | 4/2004 | Nakamura et al. | 439/752 |
| 6,761,590 | B2 * | 7/2004 | Maue et al. | 439/620 |
| 6,863,568 | B2 * | 3/2005 | Nakamura | 439/595 |
| 6,945,829 | B2 * | 9/2005 | Finzer et al. | 439/752 |
| 2002/0168896 | A1 * | 11/2002 | Suzuki | 439/595 |
| 2004/0171317 | A1 * | 9/2004 | Finzer et al. | 439/752 |
| 2005/0085126 | A1 * | 4/2005 | Sagawa et al. | 439/595 |
| 2005/0090148 | A1 * | 4/2005 | Sagawa et al. | 439/595 |

FOREIGN PATENT DOCUMENTS

| | | |
|---|---|---|
| DE | 200 20 376 | 4/2002 |
| EP | 1 168 518 | 1/2002 |

* cited by examiner

*Primary Examiner*—Gary F. Paumen
(74) *Attorney, Agent, or Firm*—Kenyon & Kenyon LLP

(57) ABSTRACT

A coupler plug, in particular for a planar lambda probe, made up of a housing, i.e., a base element and a cover element, as well as electrical components, which may be placed inside in the housing and fixed in place, and a balancing unit for a probe, in particular a planar broad-band lambda probe, which is to be mounted inside the coupler plug or, via an additional contact element, outside the coupler plug, a secondary locking element being provided as locating element to fixate at least one electrical flat plug-connector placed inside in the housing. In addition to the flat plug-connectors, flat contacts are provided in the plug housing, which are able to be fixed in place simultaneously by means of the secondary locking element, the secondary locking element having, on a first level A, receiving device for the flat plug-connectors in the form of a locking plate, and, on an additional level B, a locating device in the form of a locking hook.

6 Claims, 4 Drawing Sheets

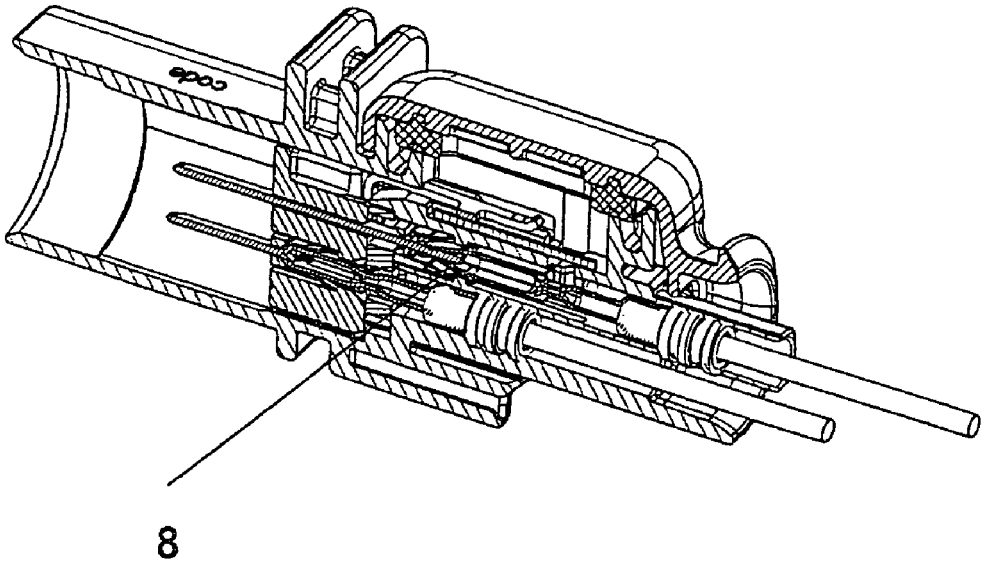
Fig. 7
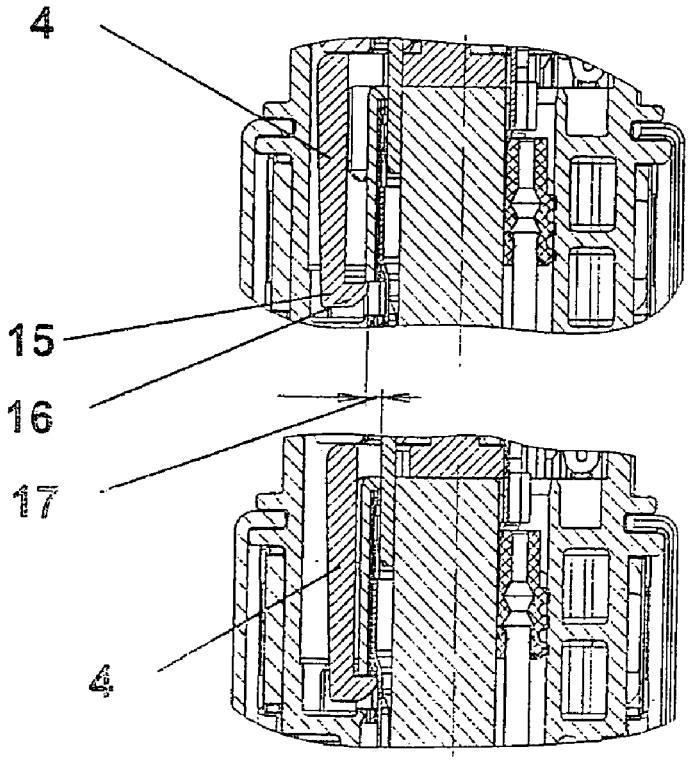
Fig. 8
Fig. 9

SECONDARY LOCKING OF A PLUG-IN CONNECTION ON TWO PLANES

FIELD OF THE INVENTION

The present invention relates to a coupler plug, specifically for a planar lambda probe, comprising

- a housing, namely a base element and a cover element; as well as
- electrical components, which may be placed inside the housing and fixed in place; and
- a balancing element for a probe, in particular a planar broad-band lambda probe, which is to be accommodated inside the coupler plug or, via a further contact element, outside the coupler plug;
- a secondary locking element being provided as locating element for fixating at least one electrical flat plug-connector inserted in the housing.

BACKGROUND INFORMATION

Coupler plugs are usually configured for the connection between a cable harness plug and a lambda probe, the connectors in the coupler plug being provided for balancing, signaling, and/or heating of the probe. The lambda probe and lambda closed loop control represent an effective exhaust gas cleaning method in conjunction with the three-way catalyst. The lambda probe, which, for example, is screwed into an exhaust gas system, includes a measuring sensor for determining the oxygen concentration of the exhaust gas.

The residual oxygen content is very suitable as a measured variable and regulates the air/fuel ratio, since it accurately indicates whether the air/fuel mixture is combusting completely.

In this regard, the lambda probe delivers a voltage signal which represents the momentary value of the mixture's composition and tracks changes in the mixture. The fuel supply to the engine is regulated by a mixture formation system in accordance with the signal from the lambda probe in such a way that a stoichiometric air-fuel ratio $\lambda=1$ will be achieved. Heated or unheated probes are utilized, depending on the design of the exhaust gas system and the operating conditions. The lambda probe has other uses apart from motor vehicles, e.g., for regulating gas motors or oil/gas burners in heating systems.

Broad-band lambda probes, in particular, are constructed in a modular way, and permit the integration of several functions in connection with planar technology. They usually have functional layers, which are made up of a porous protective layer, an external electrode, a sensor foil, an internal electrode, a reference air channel foil, an insulation layer, a heating element, a heating foil, a resistor or a balancing element, and terminal contacts.

Since the broad-band lambda probe is made up of the combination of a Nernst concentration cell (=sensor cell) with an oxygen ion-transporting pump cell, it can measure very accurately not only at the stoichiometric point where lambda=1, but also in the lean and the rich range.

Each probe has to be adjusted individually. For this, the probe has a built-in resistor (mini-hybrid). The adjustment, which is preferably made with the aid of a laser beam, is done in such a way that the resistor layer, which is on a ceramic substrate, is correspondingly removed, whereby a change in resistance is brought on, which results in an adjustment.

One specific embodiment is seen in the fact that the balancing unit, or the resistor, is arranged right on the probe.

A further exemplary embodiment is seen in the fact that the resistor is accommodated outside, for example on a cable harness plug that is coupled to the probe.

To prevent moisture, dirt or similar substances from penetrating the coupler plug in which the corresponding lambda probe is arranged as well, and to ensure that the corresponding atmosphere prevails inside the coupler plug, the coupler plug has sealing elements, which are arranged on the cover element, for instance, or on additionally provided pressure-equalizing elements.

Coupler elements of the aforementioned type may be embodied in various forms. They are generally multi-pin coupler plugs, which have corresponding flat plug-connectors.

Other designs have flat plug-connectors exclusively.

Some other designs have combinations of flat plug-connectors and flat contacts.

In particular when using coupler plugs that have multiple poles and accommodate flat contacts and simultaneously also flat connectors in one coupler plug, it is provided to make available at least one secondary locking mechanism in the flat plug-connector region so as to fixate the flat contacts disposed in the housing, and to additionally include a further secondary locking mechanism for the flat contacts so as to fixate them in the housing in a corresponding manner as well.

One disadvantage of the last mentioned specific embodiment of coupler plugs is that it requires additional work and installation steps to implement a corresponding fixation by means of a secondary locking mechanism both of flat plug-connectors and flat contacts. In addition, multiple controls are necessary in order to ascertain whether the fixation of the flat plug-connectors or the flat contacts has been accomplished successfully.

SUMMARY OF THE INVENTION

It is an object of the invention to avoid the disadvantages of the cited related art.

The object is achieved in that, in addition to the flat plug-connectors, flat contacts are provided in the housing, which are able to be fixated simultaneously by means of a secondary locking element. On a first level, the secondary locking element has receiving devices for the flat plug-connector in the form of a sliding plate and, on an additional level, a locating device in the form of a locking hook.

An essential advantage of the design approach according to the present invention is that a locking on two different levels may be achieved using a single component.

On the one hand, the locking of the flat plug-connector contacts is accomplished by providing a sliding plate, while the locking hook which faces away from the sliding plate brings about an additional locking of the flat contacts by sliding the secondary locking mechanism into the plug housing. The secondary locking mechanism embodied according to the present invention is preferably a one-piece component. This also reduces the stocking and storing of the components, and increases the multitude of possible coupler-plug designs, without increasing the number of components itself.

Another advantage is that current designs of coupler plugs that include both plug-in devices, namely flat contacts and flat plug-connectors, need not be modified, since the secondary locking mechanism according to the present invention adapts itself to the existing design of coupler plugs.

BRIEF DESCRIPTION OF THE DRAWINGS

FIG. 7 shows a longitudinal section through a coupler plug according to FIG. 2, but with an additionally included flat contact.

FIG. 8 shows a part-section through the coupler plug according to FIG. 7, the secondary locking mechanism depicted being in a pre-locking position.

FIG. 9 shows a part-section through the coupler plug according to FIG. 7, the secondary locking mechanism depicted being in a final position.

DETAILED DESCRIPTION

Figure 1:
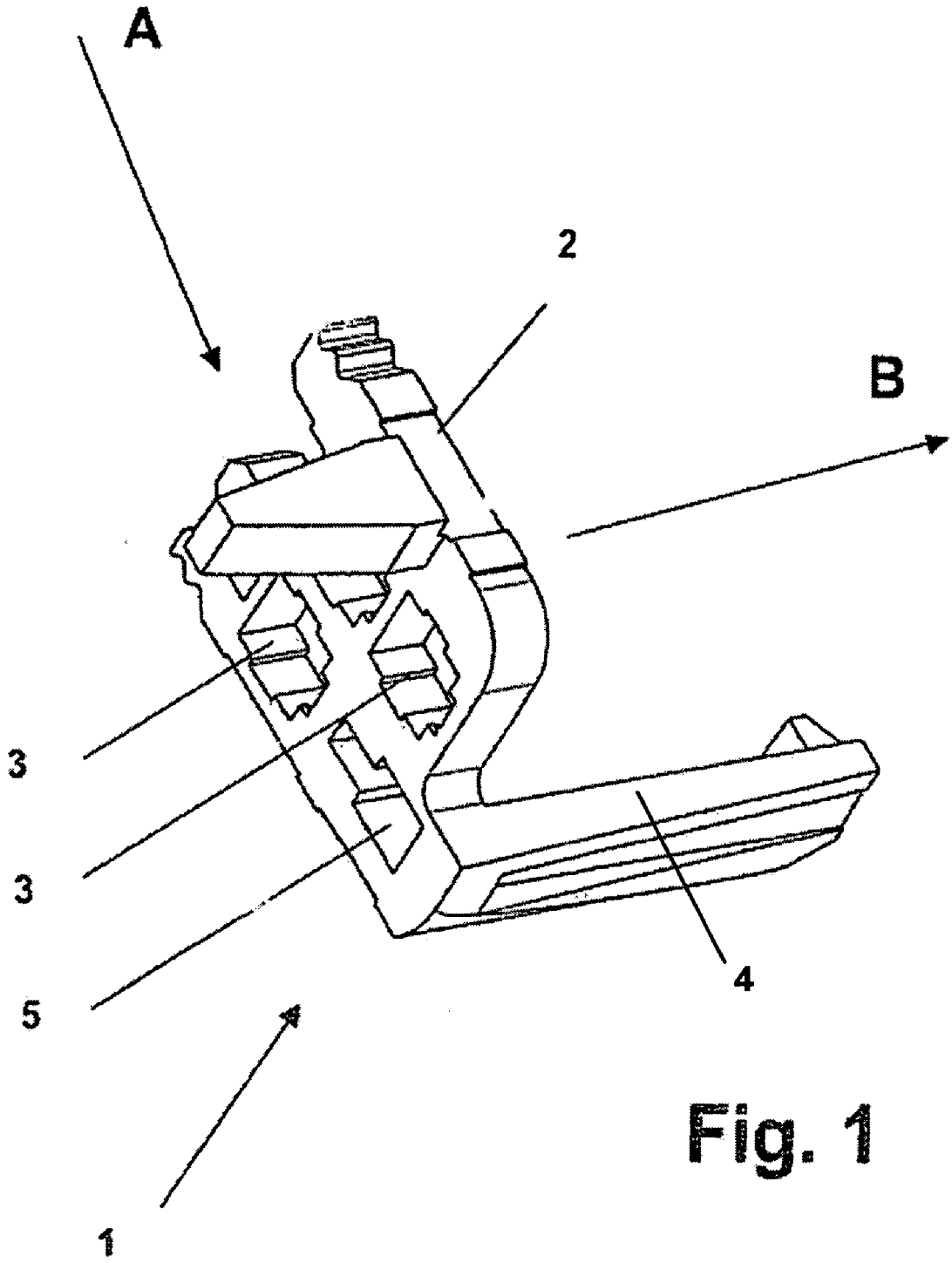
FIG. 1 shows a perspective view of the specific embodiment of a secondary locking mechanism according to the present invention.

FIG. 1 shows secondary locking mechanism 1 according to the present invention. This secondary locking mechanism 1 has two levels, A, B. A locking plate 2, which is able to accommodate and fixate flat plug-connectors (not shown further in the drawing) by means of receiving device 3, is provided on first level A.

A locking hook 4, which points away from locking plate 2, is provided on the additional level B. This locking hook 4 fixates the flat contacts, which are not shown further in the drawing and pass through the locking plate through opening 5.

Secondary locking mechanism 1 is a one-part plastic injection-molded part. According to FIGS. 2 through 4, this secondary locking mechanism is inserted in a plug housing 6 of a coupler plug K so as to secure flat plug-connectors 7 and flat contacts 8, in particular, which are arranged inside plug housing 6.

Once these components have been inserted into plug housing 6, a contact support base 9, which engages with secondary locking mechanism 1, must be pushed into the side of secondary locking mechanism 1.

Figure 3:
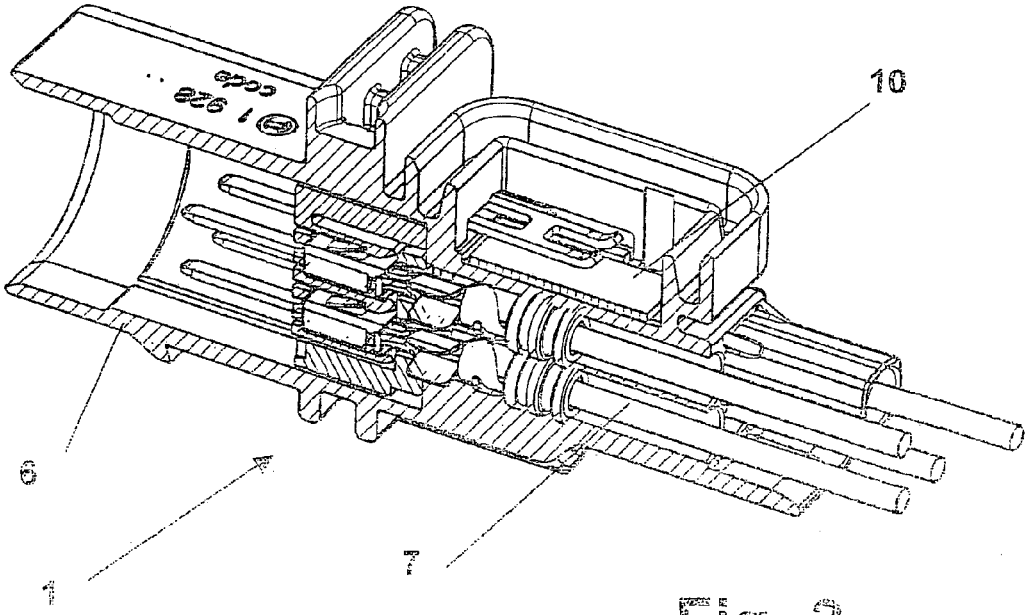
FIG. 3 shows a longitudinal section through a coupler plug according to FIG. 2.

A balancing resistor 10, which is protected from dirt, moisture and such by a cover 11 together with a seal 12, is disposed in plug housing 6 (cover 11 and seal 12 are not shown in FIG. 3 for reasons of clarity).

Figure 2:
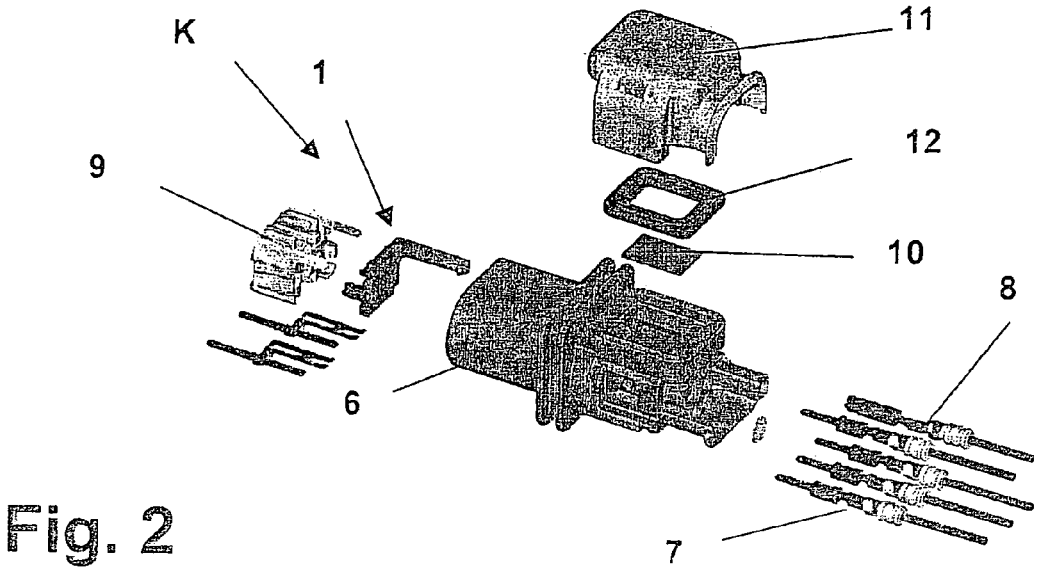
FIG. 2 shows a perspective view of a coupler plug having the secondary locking mechanism according to the present invention as shown in FIG. 1, in an exploded view.
Figure 4:
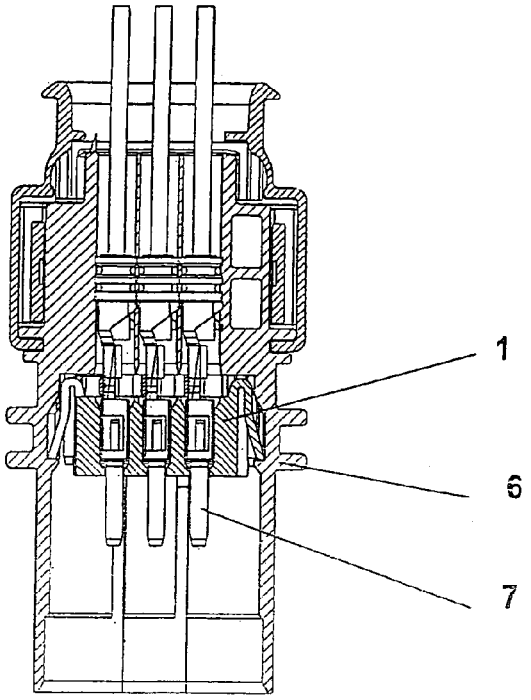
FIG. 4 shows a cross section through the coupler plug according to FIG. 2.
Figure 5:
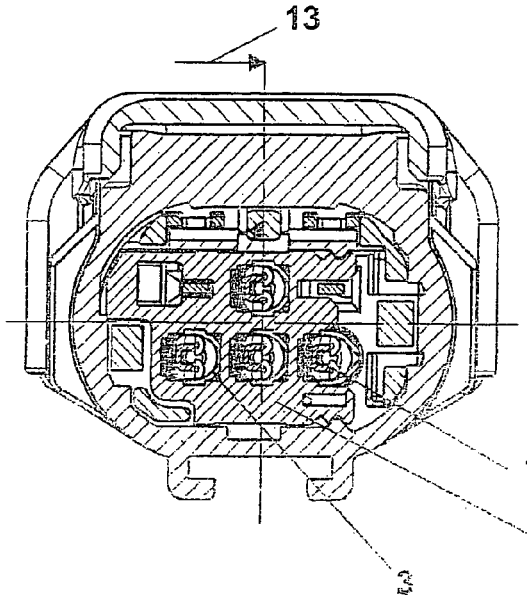
FIG. 5 shows another cross section through the coupler plug according to FIG. 2, the secondary locking mechanism being in a pre-locking position.
Figure 6:
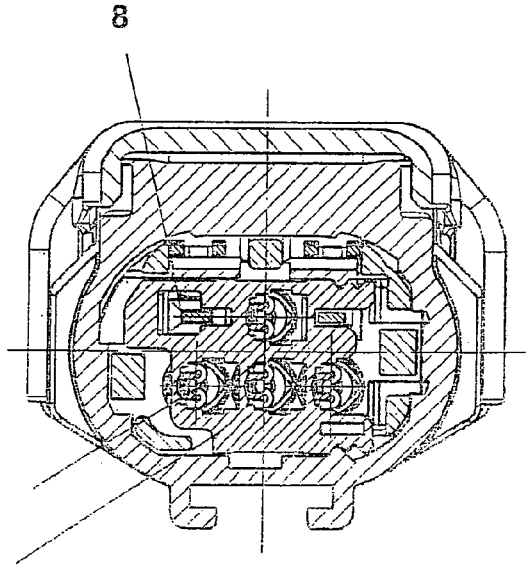
FIG. 6 shows another cross section through the coupler plug according to FIG. 2, the secondary locking mechanism being in a final position.

FIG. 5 depicts secondary locking mechanism 1 according to the present invention in a so-called pre-locking position. This pre-locking position is attained directly after installation of coupler plug K shown in FIGS. 2 through 4, depicted flat plug-connectors 7 being arranged with clearance with respect to secondary locking mechanism 1. By displacing the secondary locking mechanism in the direction of arrow 13, the direct locking is brought about by secondary locking device 1 assuming the final position, and individual flat plug-connectors 7 are fixed in place. Flat contacts 8 shown in FIGS. 5 and 6 remain unaffected by the movement of the secondary locking mechanism in arrow direction 13.

Pushing secondary locking mechanism 1 into plug housing 6 simultaneously achieves a pre-locking position of the secondary locking mechanism for flat contacts 8 shown in FIGS. 7 through 9. According to FIG. 8, locking hook 4 pointing away from locking plate 2 transitions to a so-called pre-locking position. By sliding the secondary locking mechanism in arrow direction 14, a lip 15, which is part of locking hook 4, engages behind a recess 16 and travels a defined path 17, thereby resulting in a fixation of flat contact 8.

Forming secondary locking mechanism 1 for the cable-harness plug on two levels not only facilitates the installation, but also makes it possible to produce this cable-harness plug in a very cost-effective manner.

What is claimed is:

1. A coupler plug, comprising:

a housing;

electrical components fixed in place in the housing;

a balancing element for a probe, the balancing element being mounted one of within the coupler plug and, via a further contact element, outside the coupler plug;

at least one electrical flat plug-connector;

a secondary locking element for serving as a locating element for fixating the at least one electrical flat plug-connector inserted in the housing; and flat contacts provided in the plug housing and capable of being fixed in place simultaneously with the aid of the secondary locking element, wherein:

the secondary locking element includes on a first level A a receiving device for the at least one electrical flat plug-connectors in the form of a locking plate, the secondary locking element includes on an additional level B a locating device in the form of a locking hook.

2. The coupler plug as recited in claim 1, wherein:

the coupler plug is for a planar lambda probe.

3. The coupler plug as recited in claim 2, wherein:

the planar lambda probe includes a planar broad-band lambda probe.

4. The coupler plug as recited in claim 1, wherein:

the housing includes a base element and a cover element.

5. The coupler plug as recited in claim 1, wherein the locking hook points away from the locking plate at least in an approximately perpendicular manner.

6. The coupler plug as recited in claim 1, wherein the locking plate and the locking hook form an integral component.

* * * * *